United States Patent [19]

Hamlin

[11] 4,305,576

[45] Dec. 15, 1981

[54] SHEET SEPARATOR

[75] Inventor: Thomas L. Hamlin, Macedon, N.Y.

[73] Assignee: Xerox Corporation, Stamford, Conn.

[21] Appl. No.: 81,594

[22] Filed: Oct. 3, 1979

[51] Int. Cl.[3] ..... B65H 1/06; B65H 3/12

[52] U.S. Cl. ..... 271/11; 271/20; 271/106; 271/161

[58] Field of Search ..... 271/3.1, 5, 11, 20, 271/35, 90, 94, 97–99, 104–106, 112, 132, 133, 161, 165–167, 276

[56] References Cited

U.S. PATENT DOCUMENTS

| | | | |
|---|---|---|---|
| 2,817,519 | 12/1957 | Beck | 271/94 |
| 3,424,453 | 1/1969 | Halbert | 271/35 |
| 3,690,644 | 9/1972 | Halbert | 271/98 |
| 3,844,551 | 10/1974 | Morrison | 271/99 |
| 3,973,768 | 8/1976 | Shannon | 271/166 |

*Primary Examiner*—Robert W. Saifer

[57] ABSTRACT

An automatic document handler adapted to receive a stack of a stack of documents to be copied for feeding the documents seriatim to the platen of a copy machine and returning the copied documents to the stack. A combination vacuum-document separator in conjunction with an air knife and a document tray having a "U" shaped pocket with ramps formed on both sides thereof is provided to assure positive feeding of various sized documents without misfeeds or multifeeds.

2 Claims, 5 Drawing Figures

SHEET SEPARATOR

REFERENCE TO COPENDING APPLICATIONS

Reference is hereby made to the following copending applications filed concurrently herewith and assigned to the assignee of the present application.

Application Ser. No. 081,497, entitled "Sheet Separator", filed by Thomas J. Hamlin; Application Ser. No. 081,498 entitled "Stack Tray for Sheet Separator", filed by S. Warren Lohr; Application Ser. No. 081,499, entitled "Document Handler", filed by Thomas J. Hamlin; Application Ser. No. 081,591, entitled "Sheet Separator", filed by Morton Silverberg; Application Ser. No. 081,592, entitled "Interrupted Jet Air Knife for Sheet Separator", filed by Morton Silverberg; Application Ser. No. 081,595, entitled "Method For Separating Sheets Seriatim From A Sheet Stack", filed by Morton Silverberg; Application Ser. No. 081,596, entitled "Stack For Bottom Sheet Feeder", filed by Morton Silverberg.

BACKGROUND OF THE INVENTION

With the advent of high speed xerographic copy reproduction machines wherein copies can be produced at a rate in excess of three thousand copies per hour, the need for a document handler to feed documents to the copy platen of the machine in a rapid, dependable matter was recognized to enable full utilization of the reproduction machines potential copy output. A number of document handlers are currently available to fill that need. These document handlers must operate flawlessly to virtually eliminate the risk of damaging the originals and generate minimum machine shutdowns due to uncorrectable misfeeds or document multifeeds. It is in the initial separation of the individual documents from the document stack where the greatest number of problems occur.

Since the documents must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

It is therefore the object of this invention to provide an improved vacuum feeder which consistantly feeds sheets in a positive yet gentle manner without multifeeds.

SUMMARY OF THE INVENTION

A sheet feeder for separating and feeding the bottom sheet in a sheet stack including a plurality of vacuum feed belts spaced from the bottom surface of the document stack, the sheet stack being supported on a stack tray having "U" shaped pocket formed therein, the vacuum from the feed belts causing a portion of the bottom sheet in the stack to be pulled into the pocket for contact with the vacuum feed belts.

Ramps or support wings are provided in the pocket area to provide additional support for small or very light weight sheets.

DESCRIPTION OF THE PREFERRED EMBODIMENT

Figure 1:
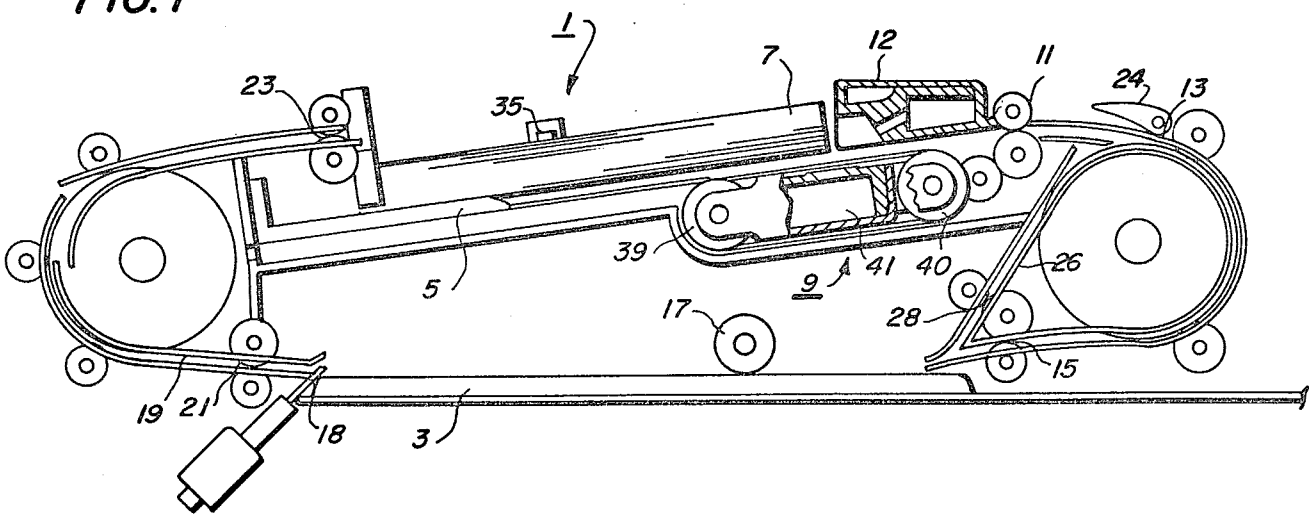
FIG. 1 is a cross-sectional view of an exemplary document handler employing the sheet separator-feeder of the present invention.

Referring to the drawings, there is illustrated an automatic document handler 1 for installation above the exposure platen 3 of a xerographic reproduction machine. The document handler is provided with a document tray 5 to be explained more fully hereinafter, adapted for supporting a stack of documents 7 face up. A vacuum belt-corrugating feeder mechanism 9 is located below the document tray for acquiring and corrugating the bottom document in the stack and forwarding the document to take away roll pair 11 after an air knife 12 has had time to separate sheet 1 from the rest of the stack. The document is then fed by take-away roll pair 11 through document guide 13 to feed-roll pair 15 and under platen roll 17 onto the platen of the copy machine for reproduction. A retractable registration edge 18 is provided to register the document fed onto the platen. Following exposure of the document, the edge is retracted by suitable means such as a solenoid and the document is fed off the platen by roll 17 into guide 19 and feed-roll pair 21 back to the document stack through the feed-roll pair 23. In the event it is desired to present the opposite side of a document for exposure, the document is fed from the stack through guide 13 until the trail edge passes document diverter 24. Document diverter is then rotated counterclockwise to block the portion of guide 13 between diverter 24 and feed-roll pair 11. The document direction is reversed and the document is diverted through guides 26 and feed-roll pair 28 onto the platen 3.

The document handler is also provided with a sheet separator finger 35 as is well known in the art to separate the documents to be fed from those documents returned to the document handler. Upon removal of the last document from beneath sheet separator finger 35, the finger 35 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Figure 2:
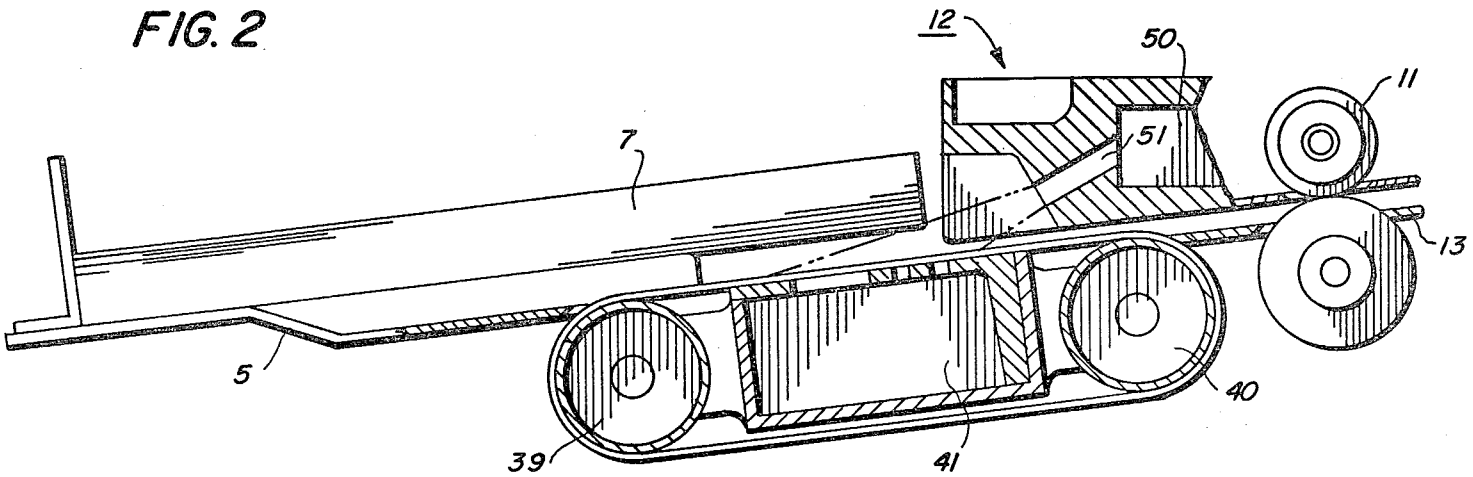
FIG. 2 is an enlarged, cross-sectional view of the separator-feeder portion of the document handler of FIG. 1.
Figure 3:
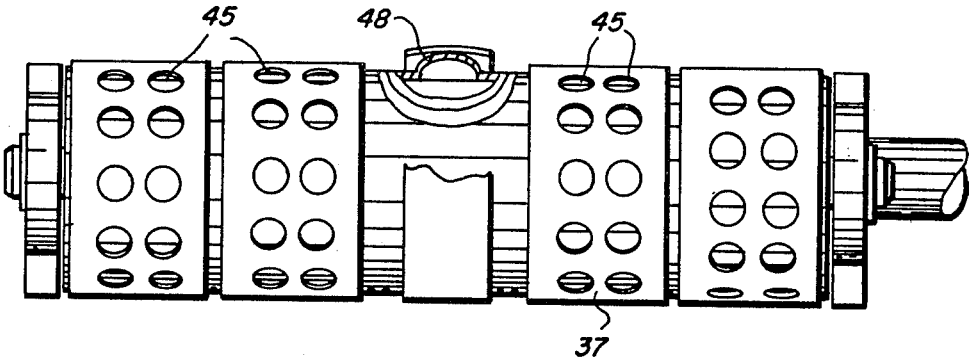
FIG. 3 is an end view, partially in section of the vacuum feed belts illustrated in FIG. 2.
Figure 4:
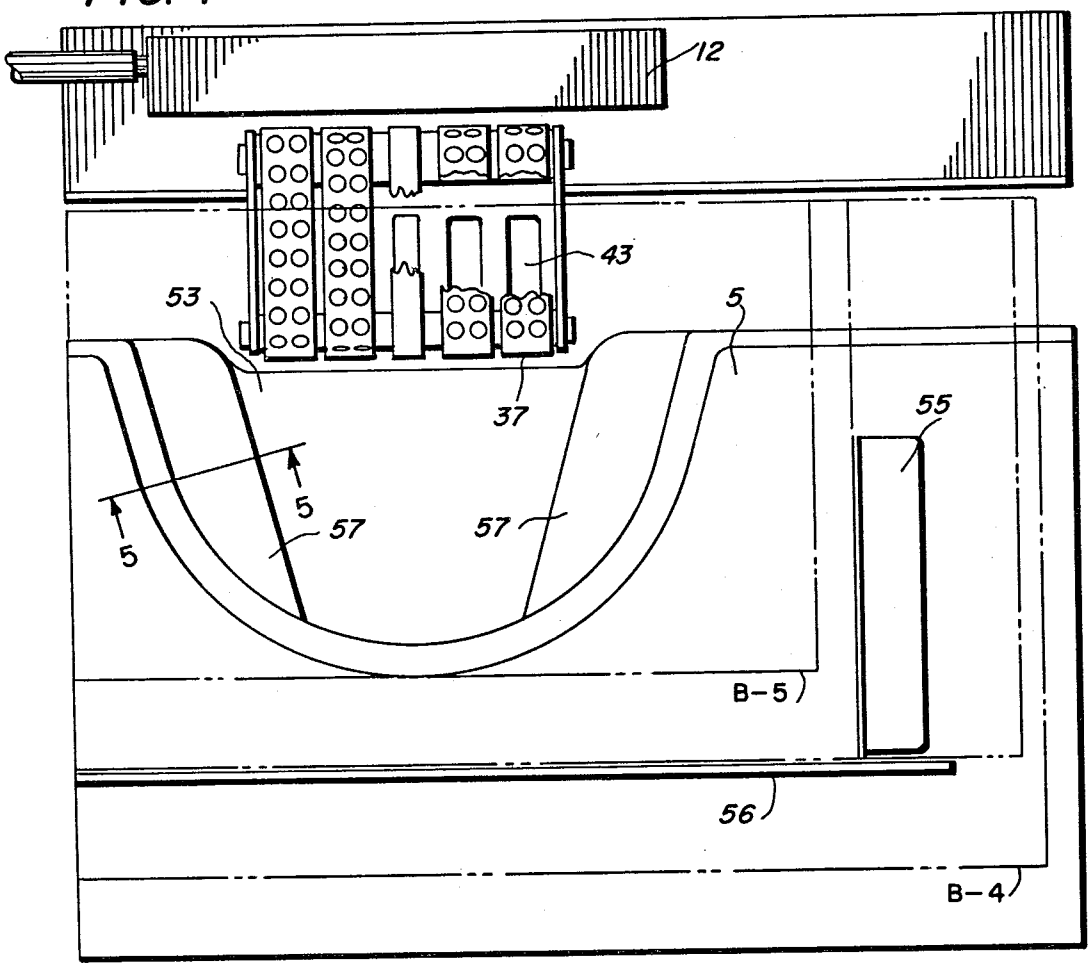
FIG. 4 is a top view of the document tray and feed belts of the document handler illustrated in FIG. 1 with common size sheets illustrated on the tray by dotted lines.

Referring more particularly to FIGS. 2, 3 and 4 wherein the novel document separator-feeder is more clearly illustrated, there is disclosed a plurality of feed belts 37 supported for movement on feed belt rolls 39 and 40. Spaced within the run of the belts 37 there is provided a vacuum plenum 41 having openings 43 therein adapted for cooperation with perforations 45 in the belts 37 to provide a vacuum for pulling the bottom documents in the document stack onto the belts 37. As can be seen from FIG. 3, the plenum is provided with a raised portion 48 beneath the center belt run so that upon capture of the bottom document in the stack against belts 37, a center corrugation will be produced in the bottom sheet. Note also that the belts are below the surrounding support surfaces. Thus the document is corrugated into a double valley configuration. The flat surfaces of the vacuum belts on each side of the raised center belt generates a region of maximum stress in the document which varies with the document beam strength. In the unlikely event that more than one document is pulled down into contact with the feed belts, the beam strength of the second document resists the corrugating action, thus gaps are opened between sheets one and two which extend to their lead edges. These gaps and channels reduce the vacuum levels between sheets one and two due to porosity in sheet one and provide for entry of the separating air flow from the air knife 12. The air knife 12 comprised of pressurized air plenum 50 having a plurality of air jet openings 51 is provided to inject air between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack.

By suitable valving and controls, it is desirable to provide a delay between the time the vacuum is applied to pull the document onto the belts and the start up of the feed belts to assure that the bottom document is captured on the belt before belt movement commences and to allow time for the air knife to separate sheet 1 from any sheets that were pulled down with it.

By reference to FIGS. 1, 2 and 4 it can be seen that the document tray 5 is provided with a depressed portion or pocket 53 having a generally parabolic outline behind the feed belt assembly. This pocket serves a number of purposes. First, space is provided for the forward portion of the bottom document to be pulled down onto the feed belt assembly providing for formation of the two valley corrugation previously mentioned. Secondly, the vacuum is applied over the area of the pocket with an air seal between the bottom document provided by the parabolic edges of the pocket. The air seal maximizes the vacuum force over the whole area of the pocket thus helping to pull the bottom document onto the feed belt assembly. A third function of the parabolic pocket is to provide for a high pressure seal between sheet 1 and the remainder of the stack. This high pressure seal is achieved by supporting a major portion of the stack weight in the edge regions of the pocket. The seal serves to reliably convert the velocity energy of the air knife flow into a lifting pressure over the pocket area.

Figure 5:
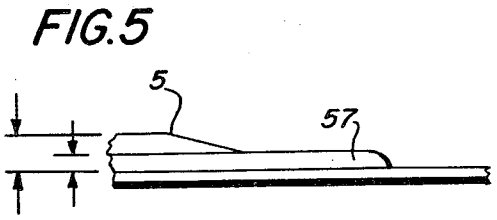
FIG. 5 is a section through a portion of the tray taken along line V—V in FIG. 4.

As may be observed with reference to FIGS. 4 and 5, the stack tray adapted for supporting a stack of sheets to be fed has a substantially planar top surface with a "U" shaped pocket formed therein. The pocket has ramps, the top surfaces of which are substantially planar, parallel to, and spaced below the planar surface of the tray. The ramps and top surface of the tray are connected by a vertically inclined member which arcuately encloses the pocket from one side, across the back of the pocket, to the other side of the pocket.

By further reference to FIGS. 4 and 5 it can be seen that the illustrated stack tray is designed such that irrespective of the size of the paper in the stack, the stack is always placed on the tray in the upper right hand corner thereof. Moveable side and back guides 55 and 56 respectively may be provided for adjusting the tray size to the size of the paper being handled as is common practice in the sheet feeding art. If desired, the tray could be designed such that the stack is always centered on the tray. In this instance, the pocket would be centrally located and moveable side guides would be provided for both sides of the tray.

The dotted lines illustrate common paper sizes. B5, which is approximately $10.12 \times 7.17$ inches and B4 which is approximately $14.33 \times 10.12$ inches are common European Size papers. Common United States sizes $8.5 \times 11$ and $8.5 \times 14$ inches are also illustrated.

Ramps or wings 57 are provided at both sides of the pocket. In the preferred embodiment, the upper surface of the tray is 0.125 inches above the upper surface of the ramps 57 and the ramps are approximately 0.125 inches thick such that the feed belts, which are located approximately even with the bottom surface of the tray are spaced approximately 0.250 inches from the top surface of the tray. With this configuration, small or light weight sheets, which may have a tendency to sag into the feed pocket are provided extra support to maintain the bottom sheet spaced from the feed belts until the feed belt vacuum is applied. The ramps do not interfere with large or heavy sheets since the beam strength thereof would prevent the combination of vacuum and air knife from forcing the sheet down the full 0.250 inches adjacent the edges of the pocket even if the ramps were not present. As such, the use of ramps 57, while providing improved feeder performance for small or light weight sheets, does not interfere with feeder performance on larger, heavy weight papers.

To further increase the efficiency of the system, the stack tray is provided with a rearward tilt as seen in FIGS. 1 and 2. When floatation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

With this disclosed arrangement of pocket geometry, air knife and spaced, corrugating feed belt assembly, optimum document separation and feed can be obtained without the necessity for retard members or multiple sheet stops. Further the system is extremely gentle, and since the feed belts are not actuated until the document is firmly captured thereon, there is a minimal slippage between the document and the feed belts and therefore smear or document degradation is practically non-existent.

While I have described a preferred embodiment of my invention, it should be understood that the invention may be otherwise embodied within the scope of the following claims.

What is claimed is:

1. A bottom sheet separator feeder for separating and forwarding sheets seratim comprising:

a stack tray adapted for supporting a stack of sheets to be fed, said tray having a substantially planar top surface with a "U" shaped pocket formed therein, said pocket having ramps, the top surface of said ramps being substantially planer, parallel to and spaced below the planar surface of said tray, said ramp and said top surface of said tray being connected by a vertically inclined member which arcuately encloses said pocket from one side, across the back of the pocket to the other side of the pocket, vacuum friction feed means disposed in said pocket, the top surface of said feed means being spaced below the planar top surface of said ramp and about at the same level as the bottom of the stack tray, said ramps supporting the stack of sheets spaced from said feed means in the absence of vacuum at said vacuum friction feed means.

2. A bottom sheet feeder according to claim 1 wherein said feed means includes;

a plurality of feed belts, and vacuum plenum means disposed within the belt runs, said plenum means having openings therein to pull the bottom sheet in the stack into said pocket and onto said feed belts when the pressure in said plenum means is reduced below atmospheric pressure.

* * * * *

UNITED STATES PATENT AND TRADEMARK OFFICE

CERTIFICATE OF CORRECTION

PATENT NO. : 4,305,576

DATED : December 15, 1981

INVENTOR(S) : Thomas L. Hamlin

It is certified that error appears in the above-identified patent and that said Letters Patent is hereby corrected as shown below:

On the title page, Inventor's name should read:

-- Thomas J. Hamlin --.

Signed and Sealed this

*Fourth* Day of *January 1983*

[SEAL]

*Attest:*

GERALD J. MOSSINGHOFF

*Attesting Officer*

*Commissioner of Patents and Trademarks*